US006505618B1

(12) United States Patent
Ben-Hador

(10) Patent No.: US 6,505,618 B1
(45) Date of Patent: Jan. 14, 2003

(54) BOOMERANG AND LAUNCHER

(76) Inventor: David Ben-Hador, Refidim Street 24/4 Maoz Aviv, 69982 Tel Aviv (IL)

( * ) Notice: Subject to any disclaimer, the term of this patent is extended or adjusted under 35 U.S.C. 154(b) by 0 days.

(21) Appl. No.: 09/701,960

(22) PCT Filed: Jun. 3, 1999

(86) PCT No.: PCT/IL99/00297

§ 371 (c)(1),
(2), (4) Date: Feb. 8, 2001

(87) PCT Pub. No.: WO99/64118

PCT Pub. Date: Dec. 16, 1999

(30) Foreign Application Priority Data

Jun. 7, 1998 (IL) ..... 124788

(51) Int. Cl.[7] ..... F41B 7/00; F41B 3/00
(52) U.S. Cl. ..... 124/16; 124/81
(58) Field of Search ..... 124/16, 79, 81

(56) References Cited

U.S. PATENT DOCUMENTS 510,936 A 12/1893 Renear
906,206 A 12/1908 Dawes et al.
925,445 A 6/1909 Bartlett
930,711 A 8/1909 Wohlmeyer
1,399,537 A 12/1921 Bayliss
3,881,729 A 5/1975 Block et al. ..... 273/106 D

FOREIGN PATENT DOCUMENTS

EP 0 017 319 A1 2/1983

*Primary Examiner*—John A. Ricci
(74) *Attorney, Agent, or Firm*—Marshall, Gerstein & Borun

(57) ABSTRACT

A launcher for a flying object, such as a boomerang, is provided having a body that includes a plurality of wings. The launcher includes a stop against which the object rests at a point on its body. A moving member engages one of the wings of the object so as to impart forward motion thereto, such that the object is propelled forward from the launcher with a rotational moment about the stop. The boomerang is preferably made from a sheet of material which is cut to form the plurality of wings, joined at a vertex, wherein one or more of the wings are folded to produce lift flaps.

10 Claims, 5 Drawing Sheets

BOOMERANG AND LAUNCHER

FIELD OF THE INVENTION

The present invention relates generally to toys and games, and specifically to flying toys and methods and apparatus for launching such toys.

BACKGROUND OF THE INVENTION

The boomerang was originally invented by the aborigines of Australia as a hunting weapon. It typically comprises two mutually-angled wings connected at a vertex. The wings are shaped so that when the boomerang is thrown in the proper manner, it will describe a circuit and return to the point from which it was thrown. Throwing the boomerang properly, however, requires considerable strength, coordination and skill. The thrower must launch the boomerang with the proper combination of forward and rotational momentum, using the muscles of his arm, hand, leg and torso, in order to obtain the desired aerodynamic effect. Boomerangs have thus achieved limited popularity as toys, due to the difficulties in throwing them and the danger that a misguided boomerang will strike a participant or bystander. Lightweight and very small boomerangs cannot generally be thrown with sufficient momentum to make them fly in a circuit.

Other flying toys known in the art, such as the Frisbee and other toys based on propellers, parachutes and flying rings, also rely on a combination of forward and rotational momentum to develop lift. Such toys do not generally have the characteristic of the boomerang of being able to return accurately to the point from which they were thrown.

European Patent Application EP071319 describes apparatus for launching a boomerang or other, similar article. A holder has a continuous slot for receiving the boomerang, with a narrow end into which the vertex is inserted and a wide end for the wings. A striker strikes the vertex through an opening in the narrow end of the holder, thus propelling the boomerang forward. A stop at one of the sides of the wide end of the holder engages and restrains the tip of one of the wings, causing the boomerang to rotate around that tip as it moves forward out of the holder.

The boomerang launcher described in this European application suffers from a number of drawbacks: (1) Because of its fixed, partly closed mechanical structure, it is capable of accepting and launching boomerangs only of a very limited range of sizes and wing angles. (2) It includes a large number of different parts, including several moving parts, which increase its cost and decrease its reliability. (3) The slot into which the boomerang must be inserted restrains the boomerang at multiple points along its length, so that a part of the energy imparted by the striker is wasted in freeing the boomerang from the launcher. (4) Further energy is wasted when the wing tip engages the stop, since force is exerted at this point on the boomerang in a direction more or less opposite to the desired flight direction. Only the other, unrestrained wing has forward momentum and can develop the lift necessary for the boomerang to fly. (5) Because the striker exerts a sudden, percussive force on the boomerang, the launcher cannot be used with boomerangs that are particularly small and flexible.

SUMMARY OF THE INVENTION

It is an object of some aspects of the present invention to provide improved apparatus and methods for launching of boomerangs and other flying toys.

It is a further object of some aspects of the present invention to provide boomerangs and launchers that can be produced simply and inexpensively, with a minimal number of separate parts.

There is therefore provided, in accordance with a preferred embodiment of the present invention, a launcher for a flying object, such as a boomerang, having a body that includes a plurality of wings, the launcher including:

a stop, against which the object rests at a point on its body; and a moving member, which engages one of the wings of the object so as to impart forward motion thereto, such that the object is propelled forward from the launcher with a rotational motion about the stop.

Preferably, the moving member includes a resilient element, which is pulled back and then released in order to impart the forward motion to the wing.

Further preferably, the launcher includes a generally planar base on which the object is placed before launching, wherein the stop and the moving element protrude from the base, wherein the base, stop and moving member are most preferably made from a single sheet of material, which is folded to form the stop and moving member.

There is further provided, in accordance with a preferred embodiment of the present invention, a launcher for a flying object, such as a boomerang, the launcher including:

a sheet of resilient material, defining a plane on which the object rests before launching; and a moving member, formed by folding a portion of the sheet, which engages the object and which is pulled back and then released so as to impart forward motion to the object.

Preferably, along with the forward motion, the moving member imparts to the object rotational motion in the plane of the sheet.

Preferably, the sheet is partially cut and is folded to form the moving member so that when the member is pulled back and released, it bends about an axis generally perpendicular to the plane of the sheet. Further preferably, the moving member includes an extension of the sheet, which is folded over itself and is then folded out of the plane and fixed to the sheet so as to form an angle of approximately 90° thereto. Most preferably, the launcher includes substantially no functional elements that are not a part of the sheet of resilient material.

There is also provided, in accordance with a preferred embodiment of the present invention, a flying toy, preferably a boomerang, including a substantially flat sheet of material, which is cut to form a plurality of wings joined at a vertex, wherein one or more of the wings are folded to produce lift flaps.

There is additionally provided, in accordance with a preferred embodiment of the present invention, a method for producing a flying toy, such as a boomerang, from a substantially flat sheet of material, including:

cutting the material to form a plurality of wings joined at a vertex; and folding one or more of the wings to form lift flaps.

There is moreover provided, in accordance with a preferred embodiment of the present invention, a method for producing a launcher for a flying object, including:

cutting a sheet of resilient material so as to define a planar portion on which the object rests before launching and a movable portion; and preparing one or more folds in the sheet, along which the movable portion of the sheet is folded to produce a moving member, which engages the object and which is pulled back and then released so as to impart forward motion to the object.

Preferably, the sheet is cut so that when the portion is folded, the moving member bends about an axis generally perpendicular to the plane of the sheet when the member is pulled back and released.

There is furthermore provided, in accordance with a preferred embodiment of the present invention, a method for launching a flying object, such as a boomerang, having a body that includes a plurality of wings, the method including:

resting the object against a stop at a point on the body of the object; and bringing a moving member into engagement with one of the wings of the object so as to impart forward motion thereto, such that the object is launched with a rotational motion about the stop.

Preferably, bringing the moving member into engagement with the one of the wings includes pulling back and releasing a resilient element.

The present invention will be more fully understood from the following detailed description of the preferred embodiments thereof, taken together with the drawings in which:

DETAILED DESCRIPTION OF PREFERRED EMBODIMENTS

Figure 1:
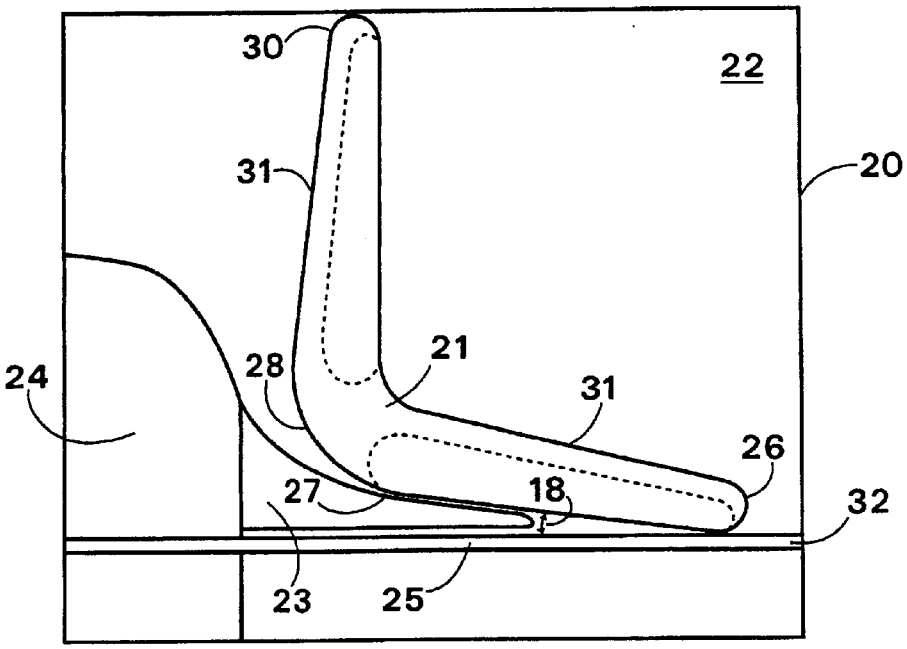
FIG. 1 is a schematic top view of a boomerang and a launcher, in accordance with a preferred embodiment of the present invention.
Figure 2:
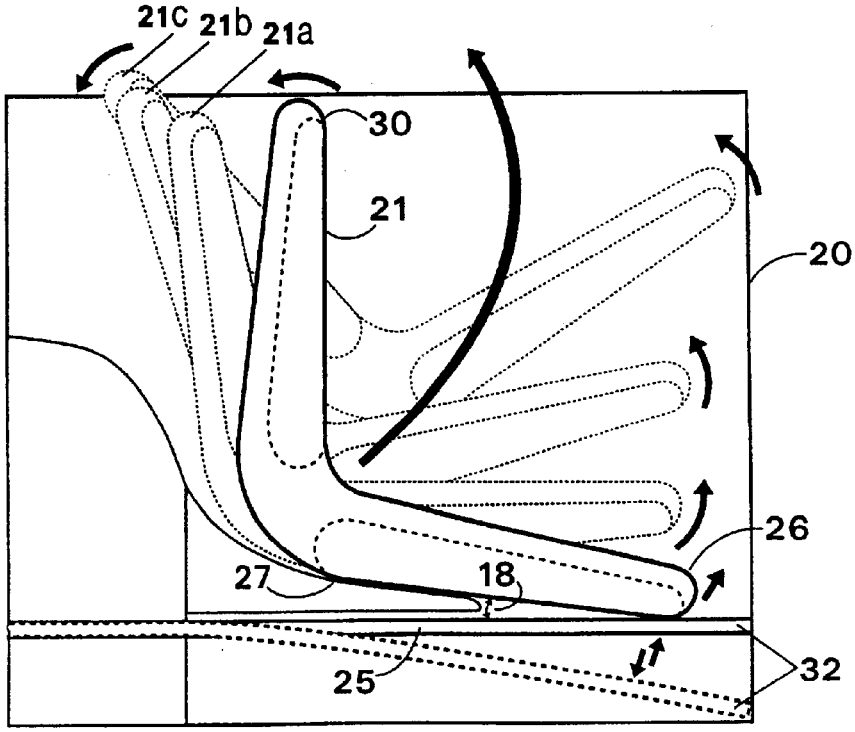
FIG. 2 is a schematic top view showing stages in the launching of the boomerang of FIG. 1.
Figure 3:
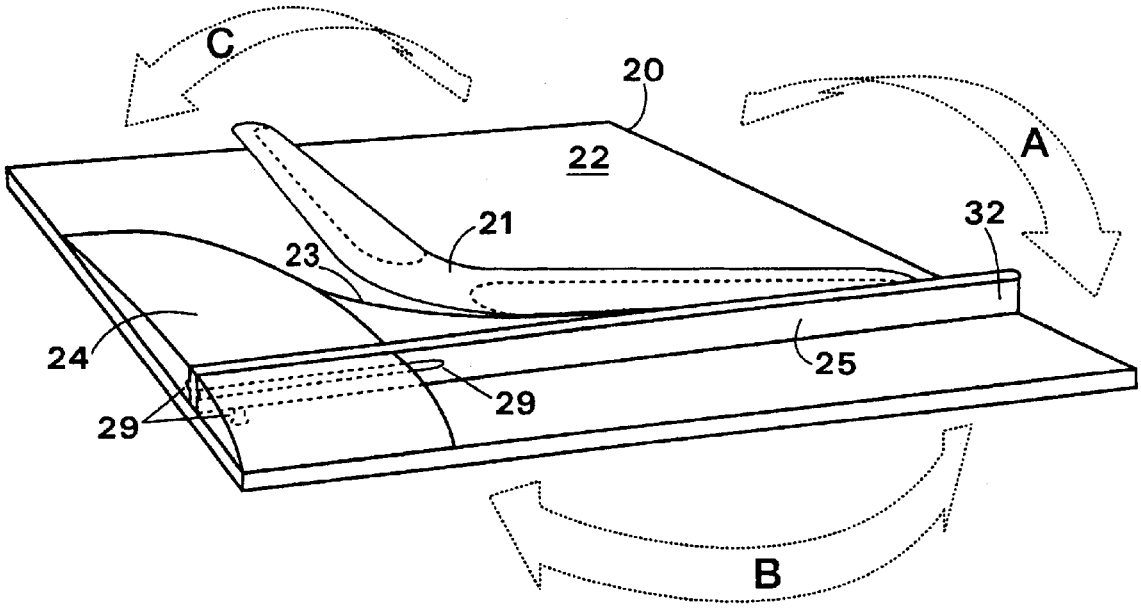
FIG. 3 is a schematic, pictorial view of the boomerang and launcher of FIG. 1.

Reference is now made to FIGS. 1, 2 and 3, which schematically illustrate a boomerang 21 and a boomerang launcher 20, in accordance with a preferred embodiment of the present invention. FIGS. 1 and 2 are top views, while FIG. 3 is an isometric, pictorial view. In FIG. 2, boomerang 21 is shown in successive positions during launch thereof, represented by outlines 21*a*, 21*b* and 21*c*.

Boomerang 21 comprises a single body made up of wings 31, which are joined at a vertex 28. The preferred structure and method of producing the boomerang are described further hereinbelow. Launcher 20 comprises a generally flat sheet 22, on whose surface boomerang 21 rests before launching. A stop 23 (or optionally, two or more stops) and a moving member 25 protrude upward from sheet 22. Prior to launching, a tip 26 of one of wings 31 rests against moving member 25, and the boomerang body rests against stop 23 at a point 27. It is noted that the position of the boomerang relative to the launcher is not fixed, and tip 26 can be moved along to various positions along member 25, thereby varying an angle 18 defined between the wing and the member and altering the flight characteristics of the boomerang. It is further noted that the illustrated structure of launcher 20 is capable of accommodating boomerangs of different sizes, shapes and vertex angles, unlike the launcher described in the above-mentioned European Patent Application EP071319. Boomerang 21 can even be launched in a reverse orientation, i.e., with vertex 28 pointing outward, rather than toward stop 23.

The parts of launcher 20 are preferably constructed by suitably cutting and folding a single sheet of resilient material. A preferred implementation of this type of construction is shown below in FIGS. 4, 5 and 6. Alternatively, the launcher may be assembled from multiple pieces and/or types of material, or may be molded, preferably from a suitable plastic, as is known in the art. Optionally, the launcher includes a handle 24. In the embodiment illustrated in FIG. 3, moving member 25 comprises protrusions 29 and is anchored to sheet 22 and preferably to handle 24 so as to provide mechanical strength when the member is bent in order to launch the boomerang.

To launch boomerang 21, a user places it on the surface of sheet 22, and rests it against stop 23 at the desired point 27. The position of the boomerang may be varied to create a longer or shorter lever arm between tip 26 and point 27. The desired elevation, azimuth and tilt for launch are selected, as illustrated by arrows A, B and C, respectively, in FIG. 3. Grasping handle 24, preferably between the thumb and forefinger, the user pulls back a tip 32 of member 25, as shown in FIG. 2, and then releases it suddenly. Member 25 springs back and imparts a forward momentum to tip 26. As tip 26 begins to move forward, the boomerang simultaneously acquires a rotational motion about point 27 on stop 23. The rotational and forward motion of the boomerang are imparted, as well, to an opposite wing tip 30.

Thus, unlike the launcher shown in the above-mentioned EP071319 patent application, tip 30 is not restrained in any way, and substantially all forces exerted by launcher 20 on boomerang 21 are in the direction of desired motion. Member 25 contacts boomerang 21 at a point along wing 31, rather than at the vertex of the boomerang as in EP071319. Therefore, the boomerang moves off the launcher efficiently, at high speed, with both of wings 31 contributing to generate a strong aerodynamic lift.

Figure 4:
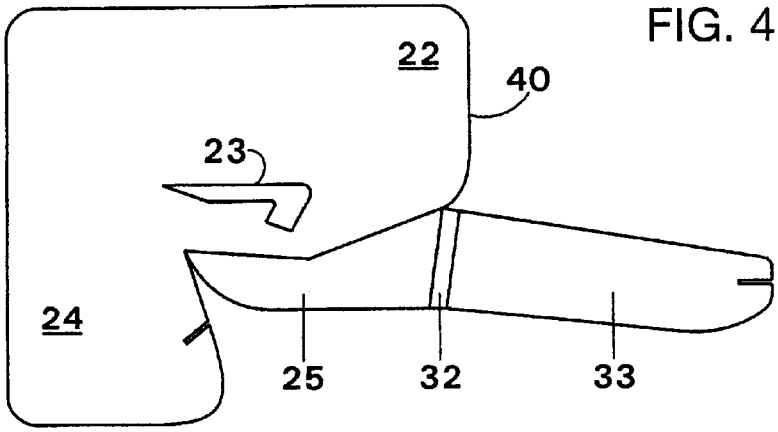
FIG. 4 is a schematic top view of a sheet of material that is cut for assembly of a boomerang launcher therefrom, in accordance with a preferred embodiment of the present invention.
Figure 5:
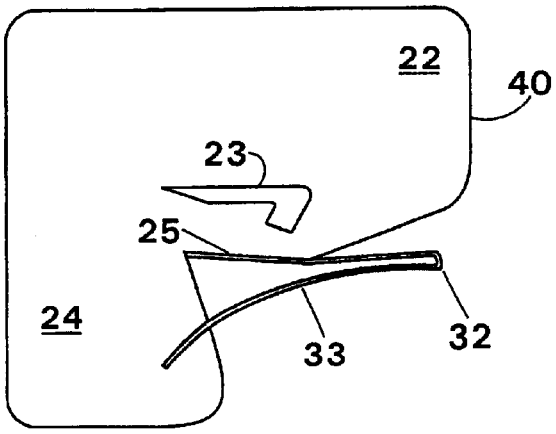
FIG. 5 is a schematic top view of the launcher assembled from the material of FIG. 4.
Figure 6:
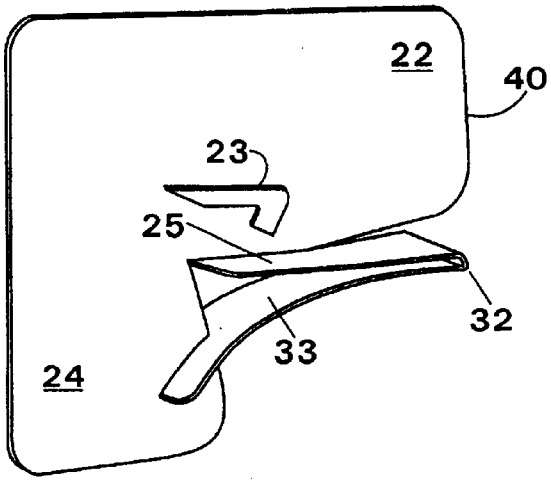
FIG. 6 is a schematic, pictorial view of the launcher shown in FIG. 5.

FIGS. 4, 5 and 6 illustrate a boomerang launcher 40, in accordance with another preferred embodiment of the present invention. Launcher 40 is functionally equivalent to launcher 20, described hereinabove, and parts of launcher 40 are labeled in the figures with the same reference numerals as are used for the parts of launcher 20 that perform similar functions. Launcher 40 has the additional advantage, however, that it is entirely made out of a single sheet of resilient material, preferably a plastic, such as polypropylene, which is suitably cut and folded.

FIG. 4 shows sheet 22 as it is cut to shape and prepared for folding. Movable member 25 is made from a long, protruding extension 33, which is partly cut away from the remainder of sheet 22. As shown in FIGS. 5 and 6, extension 33 is folded over along a line corresponding to tip 32 of member 25, and is then folded up by 90° (out of the plane of the page). A slot at the end of extension 33 engages a corresponding slot on sheet 22, so the member 25 is anchored firmly in place. In this configuration, the curved extension 33 provides mechanical strength and resilience. When member 25 is pulled back (downward in the perspective of FIGS. 5 and 6), it bends about an axis perpendicular to the plane of sheet 22, and then snaps back when released to propel the boomerang forward.

In the configuration shown in FIGS. 5 and 6, launcher 40 is most suitable for use by right-handed people, who can grasp handle 24 in their left hand and use their right hand to launch the boomerang. A launcher that is convenient for left-handed people can be produced simply by reversing the directions of the folds of extension 33 and stop 23. When boomerang 21 is launched from this "left-handed" launcher, the orientation of wing tips 26 and 30 will be reversed relative to the orientation shown in FIG. 1. This reversal may alter the flight characteristics of the boomerang.

Figure 7:
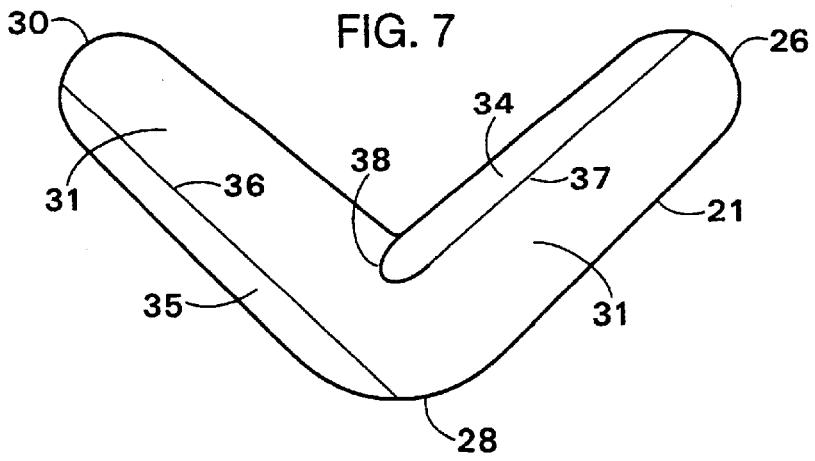
FIG. 7 is a schematic top view showing details of a boomerang, in accordance with a preferred embodiment of the present invention.
Figure 8:
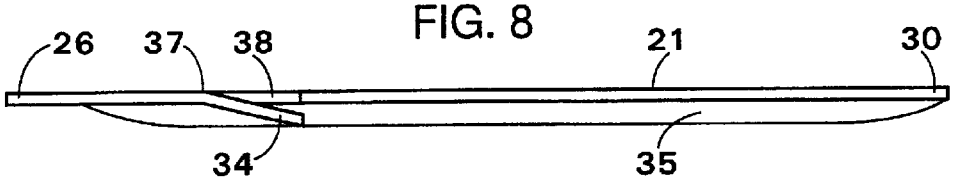
FIGS. 8 and 9 are schematic side views of the boomerang of FIG. 7.
Figure 9:
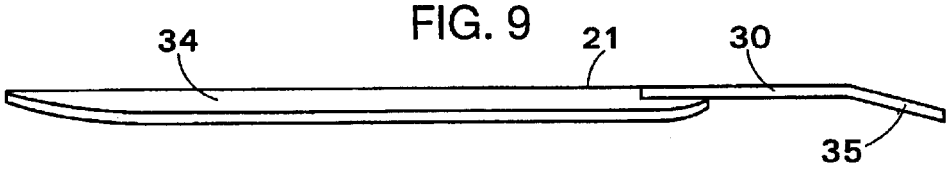
Figure 10:
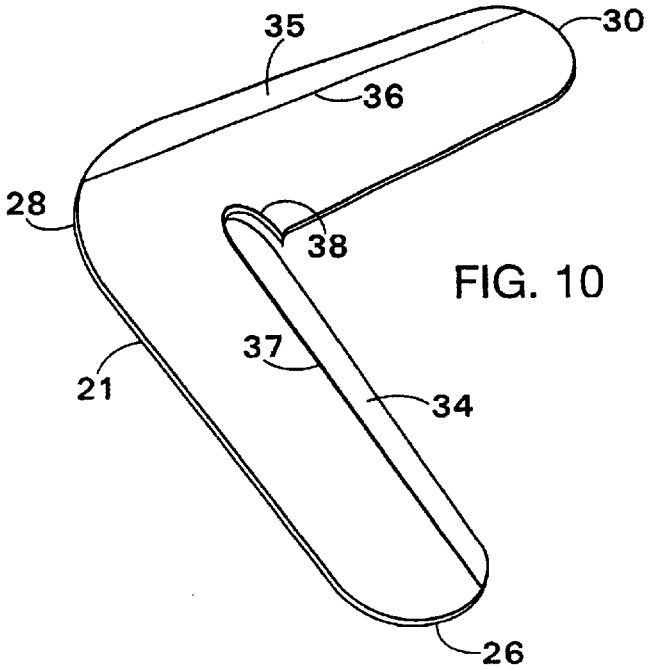
FIG. 10 is a schematic, pictorial view of the boomerang of FIG. 7.

Reference is now made to FIGS. 7, 8, 9 and 10, which are schematic illustrations showing details of boomerang 21, in accordance with a preferred embodiment of the present invention. FIG. 7 is a top view. FIGS. 8 and 9 are side views, wherein FIG. 8 shows the boomerang as seen from a point adjacent to wing tip 26, and FIG. 9, from a point adjacent to wing tip 30. FIG. 10 is an isometric, pictorial representation.

Boomerang 21 is preferably made from a flat piece of flexible, resilient material, such as polypropylene or Teslin (produced by PPG, of Pittsburgh, Penn.), which is preferably coated with a laminate on one or both sides. The sheet is bent at folds 36 and 37, preferably longitudinally and downwards by a small angle as shown in the figures, in order to produce lift flaps 34 and 35, which give the boomerang a desired degree of aerodynamic lift as it flies. A cut 38 is preferably made in the adjoining wing, so as to enable flap 34 to be folded cleanly and evenly. Flaps 34 and 35 may be adjusted to substantially any desired angle, up or down relative to the plane of wings 31, to vary the aerodynamic properties of the boomerang. The flaps obviate the need encountered in boomerangs known in the art for the wings to have a curved or variable cross section or volume for aerodynamic purposes.

Figure 11:
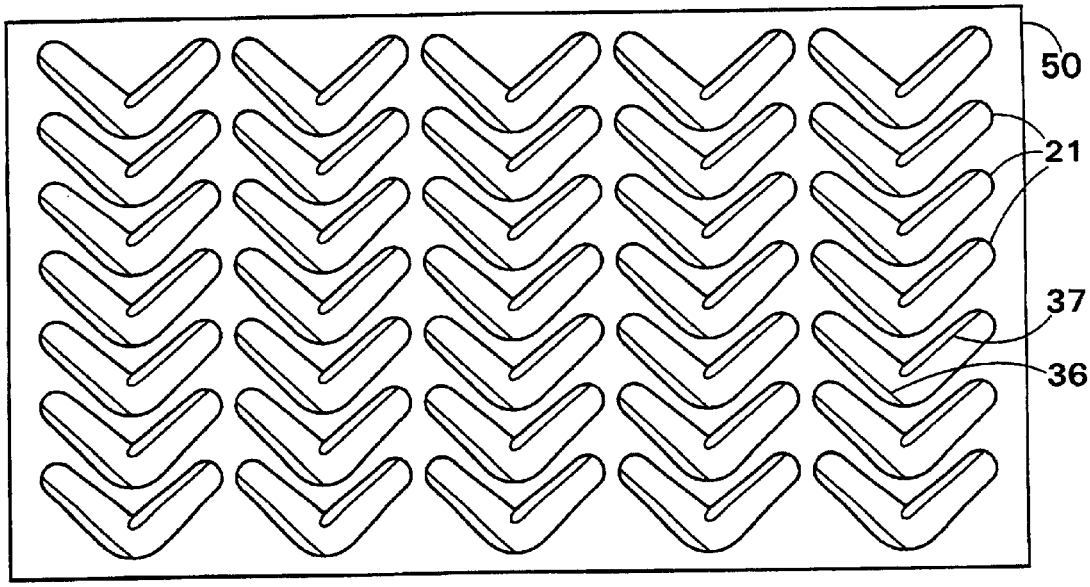
FIG. 11 is a schematic top view of a sheet of material that is cut for production of boomerangs therefrom, in accordance with a preferred embodiment of the present invention.

FIG. 11 is a schematic top view of a sheet 50 of the material from which a plurality of boomerangs 21 are made, in accordance with a preferred embodiment of the present invention. The boomerangs are preferably stamped out of sheet 50 by a suitable die, as is known in the art, enabling simple, low-cost mass-production. Most preferably, folds 36 and 37 are prepared by applying pressure and/or heat along the corresponding lines on sheet 50 while stamping out the boomerangs or beforehand. Typically, one or both surfaces of the boomerangs are printed with a desired image before stamping. Thus, substantially all of the processes involved in producing boomerang 21 (and likewise, launchers 20 and 40) can be carried out using standard equipment and techniques, well known in the printing industry.

Figure 12:
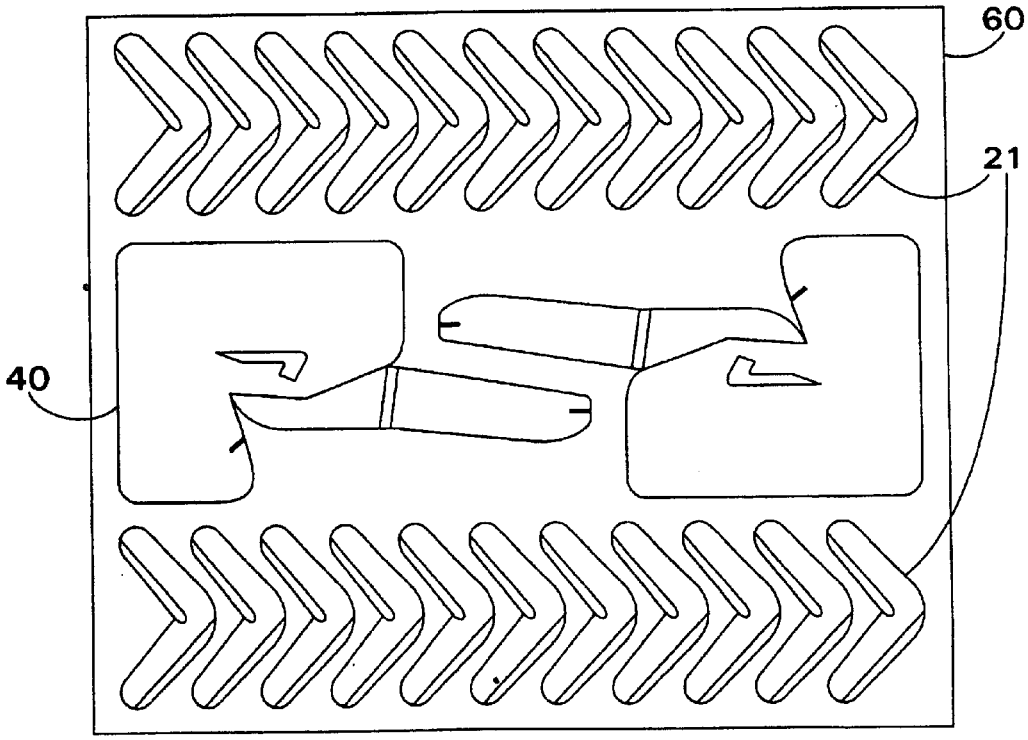
FIG. 12 is a schematic top view of a sheet of material that is cut for production of boomerangs and launchers therefrom, in accordance with a preferred embodiment of the present invention.

FIG. 12 is a schematic top view of a sheet 60 of material from which a plurality of boomerangs 21 and launchers 40 are made, in accordance with another preferred embodiment of the present invention. Both the boomerang and the launcher are thus produced from the same sheet of material, in a single process. This embodiment is particularly convenient in terms of packaging and distribution, since it enables a complete kit of one or more boomerangs and one or more launchers to be contained together on the single sheet 60.

To summarize, boomerangs and launchers in accordance with preferred embodiments of the present invention can be produced simply and inexpensively and are easy and safe to use, requiring no special skill. They require very little storage space or packaging volume, and can even be distributed as an insert in a publication. The boomerangs can be made in substantially any desired size and from any suitable material, including light, relatively flimsy materials, of a type that cannot readily be thrown by hand or propelled using launchers known in the art, such as that described in the above-mentioned European Patent Application EP071319. Compare to launchers known in the art, launchers 20 and 40 propel boomerangs with high speed and efficiency, with minimal mechanical shock to the boomerang.

Although preferred embodiments are described hereinabove with reference to a boomerang of a given shape and dimensions, it will be understood that launchers 20 and 40 are suitable substantially without change for launching boomerangs having different sizes, shapes and wing angles, unlike launchers known in the art. Launchers 20 and 40 may be used, as well, for launching flying toys of different designs, such as "boomerangs" having three or more wings. With straightforward modifications, launchers suitable for propelling a variety of other sorts of flying objects may likewise be produced in accordance with the principles of the present invention. It will thus be appreciated that the preferred embodiments described above are cited by way of example, and the full scope of the invention is limited only by the claims.

What is claimed is:

1. A launcher for a flying object, comprising:

a sheet of resilient material, defining a plane on which the object rests before launching; and a moving member, formed by folding a portion of the sheet, which engages the object and which is pulled back and then released so as to impart forward motion to the object.

2. A launcher according to claim 1, wherein the sheet is partially cut and is folded to form the moving member so that when the member is pulled back and released, it bends about an axis generally perpendicular to the plane of the sheet.

3. A launcher according to claim 2, wherein the moving member comprises an extension of the sheet, which is folded over itself and is then folded out of the plane and fixed to the sheet so as to form an angle of approximately 90° thereto.

4. A launcher according to claim 1, wherein along with the forward motion, the moving member imparts to the object rotational motion in the plane of the sheet.

5. A launcher according to claim 4, wherein the flying object comprises a boomerang.

6. A launcher according to claim 4, wherein the launcher comprises substantially no functional elements that are not a part of the sheet of resilient material.

7. A launcher according to claim 2, wherein the sheet of material is further cut to produce the flying object that is to be launched by the launcher.

8. A launcher according to claim 1, wherein the sheet is molded to form the moving member.

9. A launcher for a flying object having a body that includes a plurality of wings, the launcher comprising:

a stop, against which the object rests at a point on its body;

a moving member, which engages one of the wings of the object so as to impart forward motion thereto, such that the object is propelled forward from the launcher with a rotational motion about the stop; and a generally planar base on which the object is placed before launching, wherein the stop and the moving element protrude from the base, wherein the base, stop and moving member are made from a single sheet of material, which is folded to form the stop and moving member, and wherein the sheet is partially cut to define the base, stop and moving member before folding the sheet to form the stop and moving member.

10. A launcher according to claim 9, wherein the sheet of material is further cut to produce the flying object that is to be launched by the launcher.

* * * * *